US006295845B1

(12) United States Patent
Caselli et al.

(10) Patent No.: US 6,295,845 B1
(45) Date of Patent: Oct. 2, 2001

(54) THREAD DISPENSING DEVICE FOR DISPENSING THREAD AT A FEED OF A CIRCULAR KNITTING MACHINE

(75) Inventors: Fernando Caselli, Pontassieve; Filippo Bargellini, Fucecchio, both of (IT)

(73) Assignee: Matec S.p.A., Scandicci (IT)

( * ) Notice: Subject to any disclaimer, the term of this patent is extended or adjusted under 35 U.S.C. 154(b) by 0 days.

(21) Appl. No.: 09/790,862

(22) Filed: Feb. 23, 2001

(30) Foreign Application Priority Data

Mar. 17, 2000 (IT) ..... MI00A0569

(51) Int. Cl.[7] ..... D04B 15/60
(52) U.S. Cl. ..... 66/133; 66/125 R
(58) Field of Search ..... 66/125 R, 133, 66/134, 135, 140 R, 138, 139, 136

(56) References Cited

U.S. PATENT DOCUMENTS 5,056,339 * 10/1991 Lonati ..... 66/134
5,070,709 * 12/1991 Guell ..... 66/140 R
5,524,459 * 6/1996 Beconcini ..... 66/136
6,089,048 * 7/2000 Lonati et al. ..... 66/134
6,109,069 * 8/2000 Sangiacomo ..... 66/133
6,189,345 * 2/2001 Sangiacomo ..... 66/134

* cited by examiner

*Primary Examiner*—Danny Worrell
(74) *Attorney, Agent, or Firm*—Guido Modiano; Albert Josif; Daniel J. O'Byrne

(57) ABSTRACT

A device for dispensing at least one thread at a feed or drop of a circular machine for knitting hosiery or the like, particularly for single-cylinder circular machines. The device comprises at least one thread guide which is arranged at a feed or drop of a circular machine for knitting hosiery or the like and has an end for dispensing a thread which laterally faces the needle cylinder proximate to its upper end, in the needle work area of the machine. The thread guide can controllably move with respect to the needle cylinder for shifting its thread dispensing end along a path which has a component which is substantially parallel to the tangent, located in a plane which is substantially perpendicular to the axis of the needle cylinder, to the needle cylinder in a region at which it is arranged.

9 Claims, 3 Drawing Sheets

THREAD DISPENSING DEVICE FOR DISPENSING THREAD AT A FEED OF A CIRCULAR KNITTING MACHINE

BACKGROUND OF THE INVENTION

The present invention relates to a device for dispensing at least one thread at a feed or drop of a circular machine for knitting hosiery or the like, particularly for single-cylinder circular machines.

It is known that in single-cylinder circular machines for knitting hosiery or the like the threads used to produce the knitted item are dispensed by means of appropriate thread guides which are arranged laterally to the needle cylinder and face the needle work area with their end through which the corresponding thread is dispensed.

Proximate to the region occupied by a thread guide or by a group of thread guides, which constitutes a feed or drop of the machine, the needles that must knit are first raised, so that their beak moves beyond the dispensed thread, and then lowered, in order to form a new loop of knitting with the dispensed thread.

The position occupied by the thread dispensing point of the thread guides, in relation to the region in which the needles rise and then fall in order to form new loops of knitting, is crucial for the correct knitting-in of the thread dispensed by the thread guides. The position where the needles begin to descend can vary, during the various kinds of knitting that the machine can perform, for example, when the length of the loops of knitting is changed through a movement, parallel to the axis of the needle cylinder, of the lowering cam with respect to the needle cylinder or vice versa.

In this case, the angular position of the thread dispensing point of one or more thread guides around the needle cylinder may not be the most suitable for correct engagement of the thread by the needles that are made to knit at that feed or drop of the machine, and abnormal knitting-in can occur, leading to defects in the item being formed.

In order to solve this problem, during the adjustment of the machine the thread guide or guides are arranged in a position which is suitable for the various operating conditions of the machine.

However, this solution is not always able to achieve fully satisfactory knitting-in in the various operating conditions of the machine.

SUMMARY OF THE INVENTION

The aim of the present invention is to solve the above problem, by providing a device for dispensing at least one thread at a feed or drop of a circular machine for knitting hosiery or the like, particularly a single-cylinder machine, which allows to maintain, for the dispensed thread, optimum knitting-in conditions in the various operating conditions of the machine.

Within this aim, an object of the present invention is to provide a device which can be installed without problems in currently commercially available circular machines for knitting hosiery or the like.

Another object of the present invention is to provide a device which is structurally simple and can be manufactured at competitive costs.

This aim and these and other objects which will become better apparent hereinafter are achieved by a device for dispensing at least one thread at a feed or drop of a circular machine for knitting hosiery or the like, particularly for single-cylinder circular machines, comprising at least one thread guide which is arranged at a feed or drop of a circular machine for knitting hosiery or the like and has an end for dispensing a thread which laterally faces the needle cylinder proximate to its upper end, in the needle work area of the machine, characterized in that said at least one thread guide can move on command with respect to the needle cylinder for the movement of said thread dispensing end along a path which has a component which is substantially parallel to the tangent, laying in a plane being substantially perpendicular to the axis of the needle cylinder, to the needle cylinder in a region at which it is arranged.

BRIEF DESCRIPTION OF THE DRAWINGS

Further characteristics and advantages of the present invention will become better apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
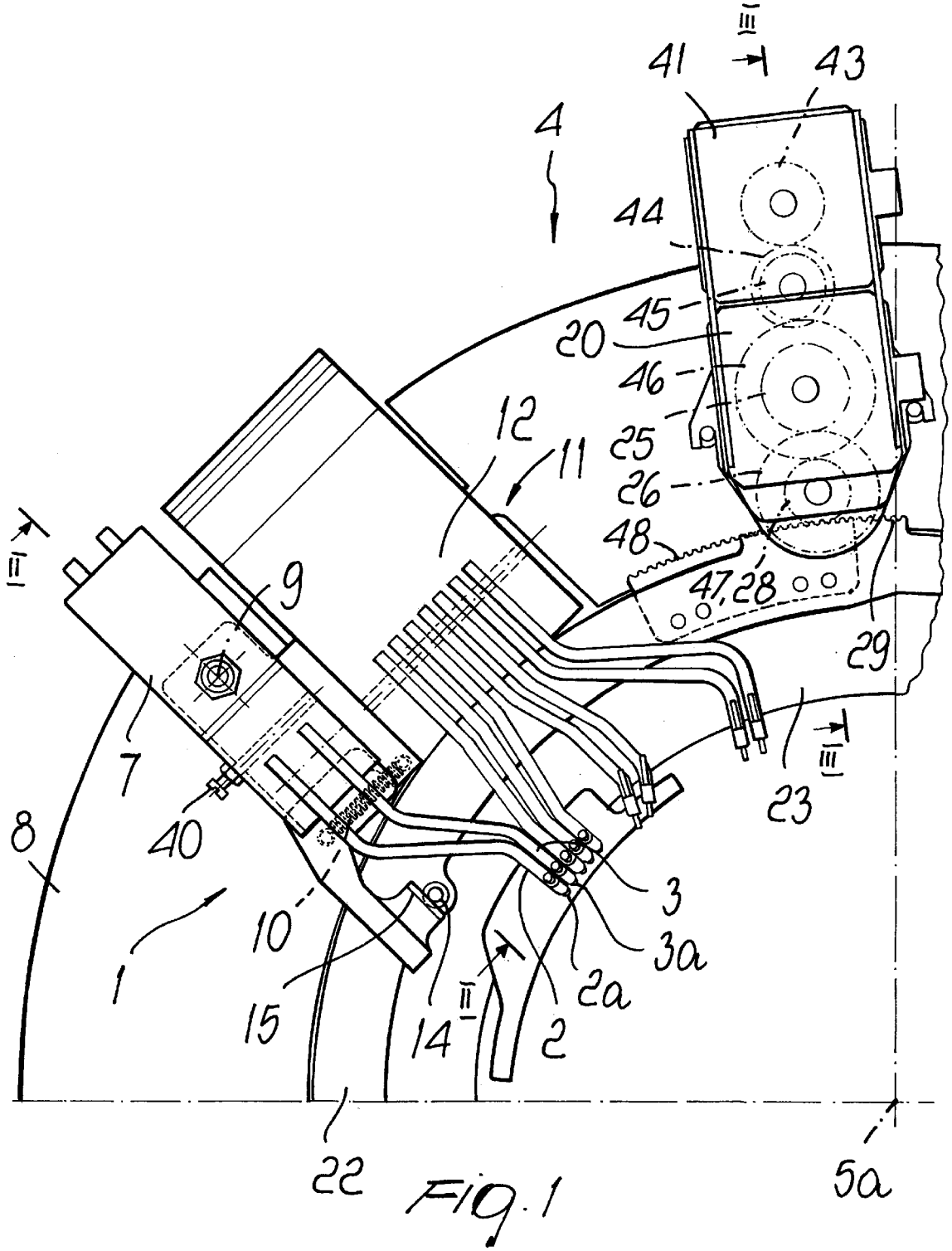
FIG. 1 is a view of the device according to the invention applied to a single-cylinder circular hosiery knitting machine, shown in a schematic top plan view.
Figure 2:
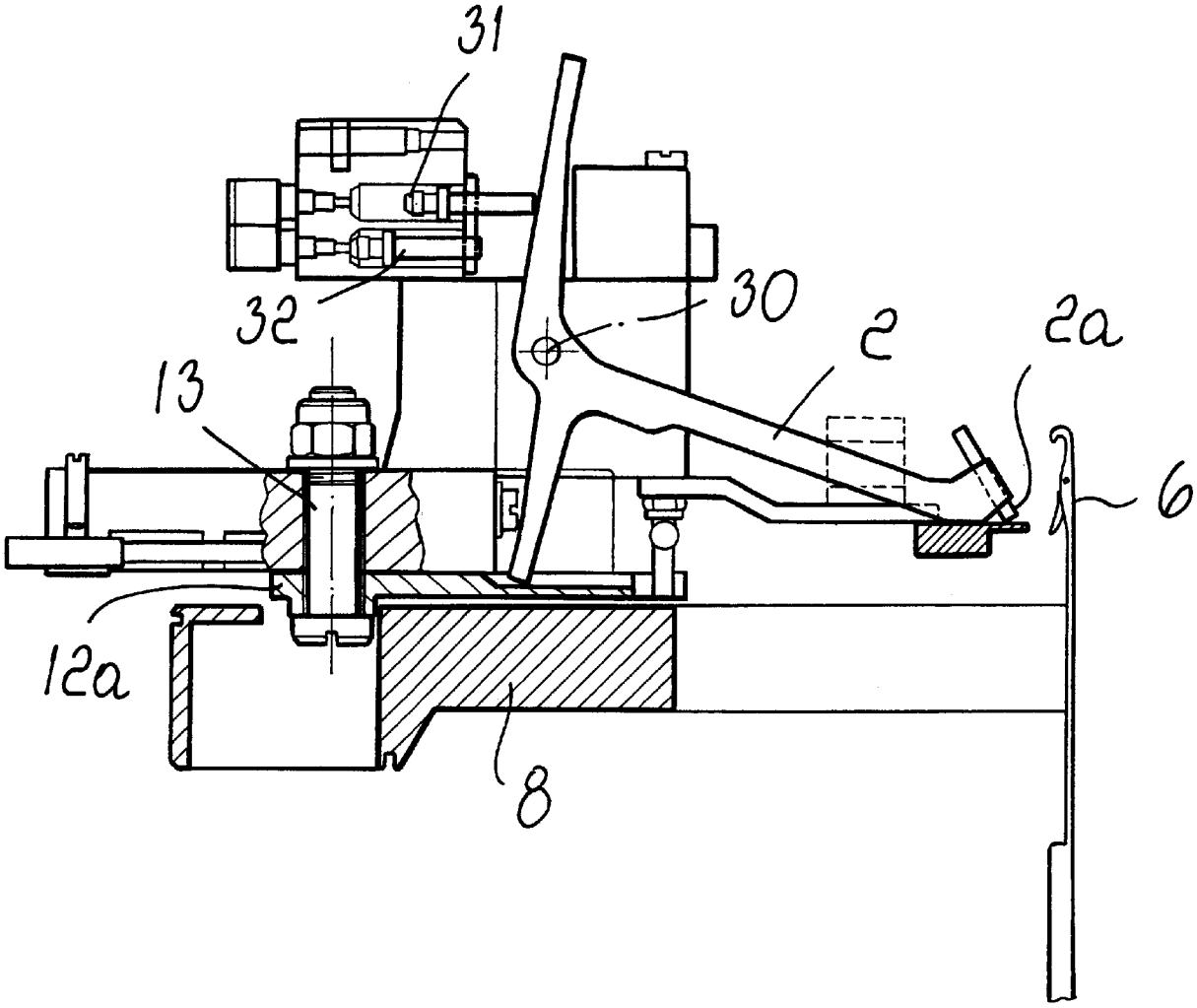
FIG. 2 is a schematic sectional view of FIG. 1, taken along the plane II—II.
Figure 3:
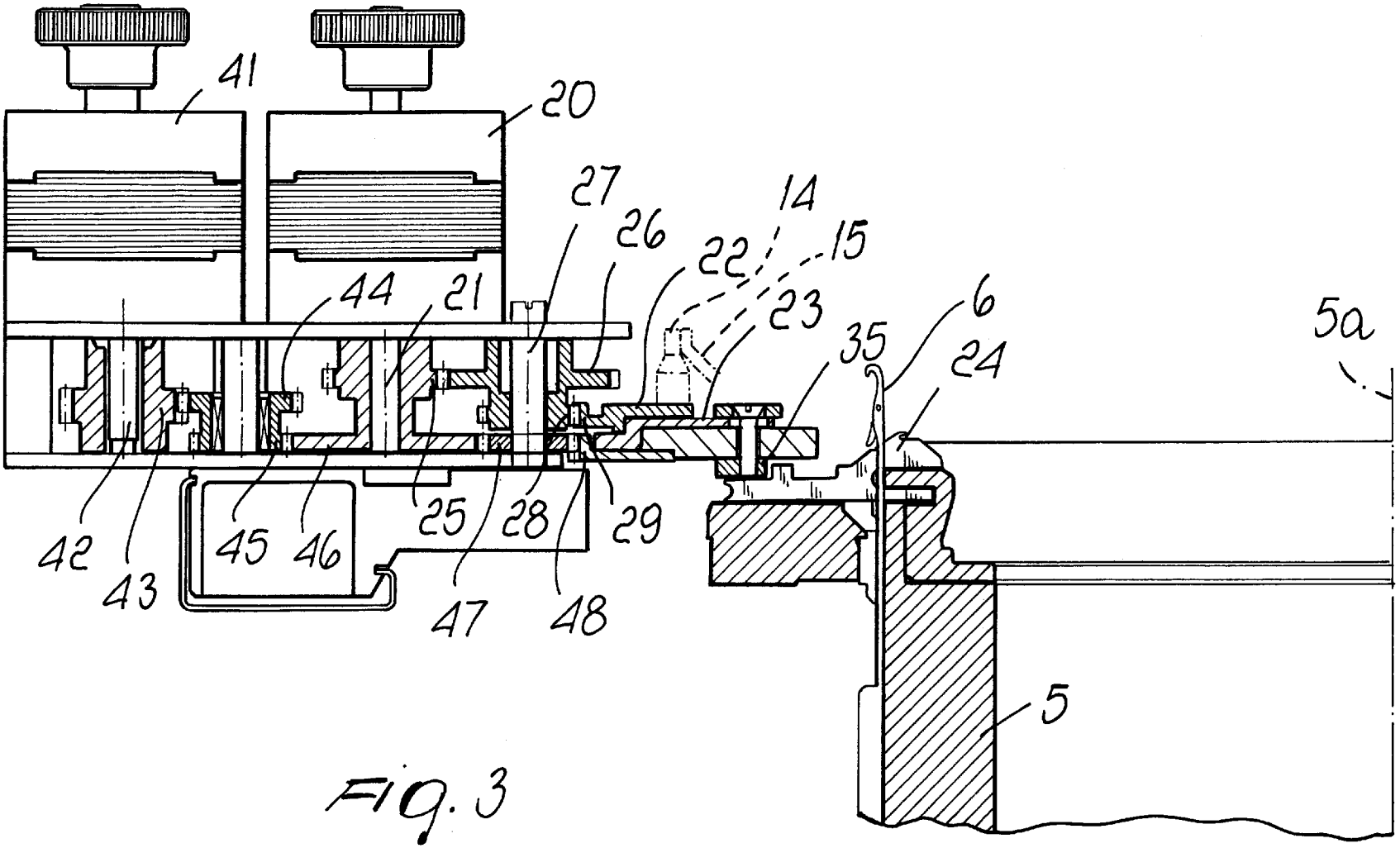
FIG. 3 is a schematic sectional view of FIG. 1, taken along the plane III—III.

With reference to the above-cited figures, the device according to the invention, generally designated by the reference numeral 1, comprises at least one thread guide 2 and 3 which is arranged at a feed or drop of a circular machine for knitting hosiery or the like, generally designated by the reference numeral 4. The thread guide 2 and 3 has a dispensing end 2*a*, 3*a* which laterally faces the needle cylinder 5 of the machine, proximate to its upper end, in the work area of the needles 6 of the machine.

According to the invention, the thread guide 2 and 3 is controllably movable with respect to the needle cylinder 5 for shifting the dispensing end 2*a*, 3*a* along a path with a component which is substantially parallel to the tangent, laying in a plane being substantially perpendicular to the axis 5*a* of the needle cylinder 5, to the needle cylinder 5 in a point located in the region at which it is arranged.

In the illustrated embodiment, the device according to the invention is composed of two thread guides 2 and 3 which are supported by a supporting element 7 which is pivoted to the supporting structure 8 of the machine about an axis 9 which is substantially parallel to the axis 5*a* of the needle cylinder 5 and is spaced laterally with respect to said axis 5*a*.

The supporting element 7 is controllably rotatable about the pivoting axis 9, in one direction, in contrast with elastic return means, which are conveniently constituted by a spring 10 in which one end is connected to a portion of the supporting element 7 which is spaced from the pivoting axis 9 and the other end is connected to an element which is connected to the supporting structure 8 of the machine.

More particularly, in the illustrated embodiment the device according to the invention is fitted on the machine to the side of another group of thread guides, generally designated by the reference numeral 11, which is arranged at the same feed or drop of the machine served by the device according to the invention.

The group of thread guides 11, of a known type, is mounted on a supporting block 12 which is fixed in a per se known manner, for example by means of screws, to the supporting structure 8 of the machine.

The supporting element 7 of the device according to the invention is pivoted, by means of a pivot 13 whose axis forms the pivoting axis 9, to a lateral extension 12*a* of the supporting block 12.

One end of the spring 10 is connected to a portion of the supporting element 7 and the other end is connected to the supporting block 12.

The device according to the invention comprises actuation means which controllably actuate the supporting element 7 in order to produce its rotation about the pivoting axis 9 and therefore produce the movement, on a substantially horizontal plane, of the dispensing end 2*a*, 3*a* of the thread guides 2 and 3 along a circular path whose axis coincides with the axis 9.

Said actuation means comprise an abutment 14 which can engage an L-shaped portion 15 of the supporting element 7. The portion 15 is spaced laterally to the pivoting axis 9 and the abutment 14 can move along a circular path, whose axis coincides with the axis 5*a* of the needle cylinder 5, through an arc which covers a preset angle, in order to produce the rotation of the supporting element 7 in one direction about the pivoting axis 9.

The actuation means for turning the supporting element 7 about the pivoting axis 9 also comprise a step motor 20, which is supported by the supporting structure 8 of the machine and is connected, by means of its output shaft 21, to the abutment 14 in order to move it around the axis 5*a* of the needle cylinder 5 through a preset angle.

More particularly, the abutment 14 can be simply constituted by a pin which is fitted on a plate 22 associated with the sinker cover 23 of the machine. The plate 22 is associated with the sinker cover 23 so that it can turn, with respect to said cover 23, about the axis 5*a* of the needle cylinder 5.

A first gear 25 is keyed on the output shaft 21 of the step motor 20 and meshes with a second gear 26 which is keyed on a shaft 27 which is parallel to the axis of the output shaft 21. The second gear 26 is rigidly coupled to a third gear 28, which is also mounted on the shaft 27 and meshes with a toothed sector 29 which is rigidly coupled to the plate 22. In practice, by actuating the step motor 20 and turning its output shaft 21 through a preset angle, the plate 22 is turned in one direction or in the opposite direction around the axis 5*a* of the needle cylinder with respect to the sinker cover 23 and with respect to the supporting structure 8 of the machine. Contact between the abutment 14 and the portion 15 of the supporting element 7, ensured by the action of the spring 10, as a consequence of the rotation of the plate 22 around the axis 5*a* of the needle cylinder 5 produces the rotation, through an angle which is proportional to the angle of rotation of the plate 22 around the axis 5*a*, of the supporting element 7 and therefore of the dispensing end 2*a*, 3*a* of the thread guides 2 and 3 about the pivoting axis 9.

Each thread guide 2 and 3 can be pivoted, in a per se known manner, about a substantially horizontal axis 30, to the supporting element 7, and it is possible to provide, on the supporting element 7, in a per se known manner, thread guide actuation means which are constituted for example by pneumatic cylinders 31 and 32 in order to produce the oscillation of the thread guides 2 and 3 about the axis 30 in order to move their dispensing end 2*a*, 3*a* from an inactive position, in which it is raised above the region where the needles 6 engage the thread, so as to prevent the needles 6 from engaging the thread dispensed by the corresponding thread guide, to at least one active position, in which it is lowered with respect to the inactive position in order to arrange itself in the region where the needles 6 engage the thread.

The rotation of the supporting element 7 about the pivoting axis 9 toward the supporting block 12 of the group of thread guides 11 can be controlled by means of a stroke limit adjustment screw 40.

For the sake of completeness in description, it should be noted that the sinker cover 23, which supports in a per se known manner the cams 35 that actuate the sinkers 24 of the machine, can be turned, about the axis 5*a* of the needle cylinder 5, through arcs covering a preset angle by means of a second step motor 41, which is supported by the supporting structure 8 of the machine and is connected by means of its output shaft 42, through a plurality of gears designated by the reference numerals 43 to 47, to a toothed sector 48 which is fixed to a peripheral portion of the sinker cover 23.

The operation of the device according to the invention is as follows.

Starting from the position shown in FIG. 1, if the machine has to perform knitting for which the thread dispensing point constituted by the dispensing ends 2*a*, 3*a* of the thread guides 2, 3 is not the most suitable as regards the correct knitting-in of the thread dispensed by said thread guides 2, 3 on the part of the needles 6 of the machine, it is possible to vary the position of the dispensing ends 2*a*, 3*a* by actuating the step motor 20, which by moving the abutment 14 around the axis 5*a* of the needle cylinder, causes the rotation of the supporting element 7 and therefore of the dispensing ends 2*a*, 3*a* of the thread guides 2, 3 about the pivoting axis 9 through an angle which can be varied according to the requirements.

By actuating the step motor 20 with an opposite direction of rotation, the dispensing ends 2*a*, 3*a* turn about the pivoting axis 9 in the opposite direction.

The step motor 20 can be controlled by the electronic control and actuation element that supervises the operation of modern machines for knitting hosiery or the like. In this case, said electronic control and actuation element, by following a preset program, drives the step motor 20 so as to vary the arrangement of the dispensing ends 2*a*, 3*a* of the thread guides 2 and 3 according to the type of knitting that the machine is to perform.

In particular, if required, the movement of the thread guides 2 and 3 about the pivoting axis 9, in order to vary the position of the dispensing end 2*a* and 3*a*, can be correlated to the actuation of other elements of the machine, for example to the actuation of the lowering cam when varying the length of the loops of knitting and/or to the actuation of the step motor 41 which, by way of the rotation of the sinker cover 23, varies the position of the cams 35 that actuate the lowering sinkers 24.

In this manner, the position of the dispensing end 2*a*, 3*a* of the thread guides 2, 3 allows to vary the path followed by the thread in the portion between the dispensing end 2*a*, 3*a* and the needles that engage the thread and thus allows to maintain optimum knitting-in conditions of the thread on the part of the needles in the various operating conditions of the machine.

In practice it has been observed that the device according to the invention fully achieves the intended aim, since by varying on command the position of the dispensing end of the thread guide or guides it allows to obtain optimum knitting-in conditions in the various operating conditions of the machine.

The device thus conceived is susceptible of numerous modifications and variations, all of which are within the scope of the appended claims; all the details may further be replaced with other technically equivalent elements.

In practice, the materials employed, as well as the dimensions, may be any according to requirements and to the state of the art.

The disclosures in Italian Patent Application No. MI2000A000569 from which this application claims priority are incorporated herein by reference.

What is claimed is:

1. A device for dispensing at least one thread at any of a feed and a drop of a circular knitting machine having a needle cylinder rotatable about an axis thereof, said device comprising at least one thread guide arranged at the feed or drop of the circular knitting machine, said at least one thread guide having an end for dispensing a thread which laterally faces the needle cylinder proximate to an upper end thereof, in a needle work area of the machine, wherein said at least one thread guide is controllably movable with respect to the needle cylinder for shifting said thread dispensing end along a path having a component substantially parallel to a tangent, laying in a plane which is substantially perpendicular to the axis of the needle cylinder, to the needle cylinder in a point located in a region at which the dispensing end is arranged.

2. The device of claim 1, comprising a supporting element for supporting said at least one thread guide, said supporting element being pivoted to a supporting structure of the machine about an axis which is substantially parallel to the axis of the needle cylinder and is spaced laterally with respect thereto.

3. The device of claim 2, further comprising elastic return means for biasing said supporting structure, said supporting element being controllably movable about said pivoting axis in one direction in contrast with said elastic return means.

4. The device of claim 3, comprising a block for supporting a plurality of contiguous thread guides, at said feed or drop of the machine, said supporting block being fixed to the supporting structure of the machine, said supporting element being pivoted, about said pivoting axis, to said block.

5. The device of claim 4, further comprising actuation means for controllably actuating said supporting element for rotation thereof about said pivoting axis.

6. The device of claim 5, wherein said actuation means comprise an abutment for engaging a portion of said supporting element, said portion being spaced laterally from said pivoting axis, said abutment being movable through a preset angle along a circular path an axis whereof coincides with the axis of the needle cylinder in order to produce rotation of said supporting element about said pivoting axis.

7. The device of claim 6, wherein said actuation means further comprise a step motor having an output shaft, connected to said abutment for actuation thereof in movement around the axis of the needle cylinder through said preset angle.

8. The device of claim 7, further comprising: a plate which is connected to a sinker cover of the machine so as to be controllably rotatable with respect to said cover about the axis of the needle cylinder, said abutment being mounted on said plate, said step motor being connected, by way of said output shaft thereof, to said plate and being actuatable so as to produce a rotation of said plate, with respect to the sinker cover, about the axis of the needle cylinder through a preset angle.

9. The device of claim 1, wherein said at least one thread guide is controllably movable on a radial plane of the needle cylinder from an inactive position, in which the guide is raised with the thread dispensing end thereof above a region where the needles engage the thread, in order to prevent the needles from engaging the thread dispensed by said thread guide, to at least one active position, in which the guided is lowered with the thread dispensing end thereof with respect to said inactive position, in order to arrange the guide with said thread dispensing end in the region where the needles engage the thread.

* * * * *